US009812801B2

(12) United States Patent
Okura et al.

(10) Patent No.: US 9,812,801 B2
(45) Date of Patent: Nov. 7, 2017

(54) CABLE HOLDING MEMBER, PLUG CONNECTOR, CONNECTOR DEVICE, FLAT CABLE, AND METHOD FOR ASSEMBLING PLUG CONNECTOR

(71) Applicant: Panasonic Intellectual Property Management Co., Ltd., Osaka (JP)

(72) Inventors: Kenji Okura, Mie (JP); Chikara Ito, Mie (JP); Mitsuru Iida, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/110,482

(22) PCT Filed: Jan. 9, 2015

(86) PCT No.: PCT/JP2015/000085

§ 371 (c)(1),
(2) Date: Jul. 8, 2016

(87) PCT Pub. No.: WO2015/105056

PCT Pub. Date: Jul. 16, 2015

(65) Prior Publication Data

US 2016/0329647 A1 Nov. 10, 2016

(30) Foreign Application Priority Data

Jan. 9, 2014 (JP) ..... 2014-002650

(51) Int. Cl.
*H01R 3/00* (2006.01)
*H01R 12/77* (2011.01)
(Continued)

(52) U.S. Cl.
CPC ..... *H01R 12/774* (2013.01); *H01B 7/08* (2013.01); *H01R 24/20* (2013.01); *H01R 24/28* (2013.01); *H01R 43/20* (2013.01)

(58) Field of Classification Search
CPC ..... H01R 12/24; H01R 12/774
(Continued)

(56) References Cited

U.S. PATENT DOCUMENTS 6,558,187 B2 * 5/2003 Aoki ..... H01R 12/85 439/496
6,739,903 B1 * 5/2004 Aoki ..... H01R 12/89 439/496
(Continued)

FOREIGN PATENT DOCUMENTS

JP H04-322087 A 11/1992
JP 2003-031288 A 1/2003
(Continued)

OTHER PUBLICATIONS

International Search Report issued in Application No. PCT/JP2015/000085 dated Mar. 31, 2015, with English translation.

*Primary Examiner* — Abdullah Riyami
*Assistant Examiner* — Nader Alhawamdeh
(74) *Attorney, Agent, or Firm* — McDermott Will & Emery LLP

(57) ABSTRACT

A cable holding member includes a stopper member and a housing. The stopper member has an attachment surface for supporting a flat cable in a folded state. The housing has a mounting surface which is provided at an opening edge of a housing space for housing the stopper member and on which the flat cable is to be placed, and recesses into which protrusions of the flat cable placed on the mounting surface are to be fitted. The flat cable is placed on the mounting surface, and then, the stopper member is inserted into the housing space of the housing. In this way, the stopper member is attached to the housing with the flat cable being supported on the attachment surface.

16 Claims, 13 Drawing Sheets

(51) Int. Cl.

| | |
|---|---|
| ***H01R 43/20*** | (2006.01) |
| ***H01B 7/08*** | (2006.01) |
| ***H01R 24/20*** | (2011.01) |
| ***H01R 24/28*** | (2011.01) |

(58) Field of Classification Search
USPC ..... 439/496, 499
See application file for complete search history.

(56) References Cited

U.S. PATENT DOCUMENTS

| | | | | |
|---|---|---|---|---|
| 6,755,683 | B2 * | 6/2004 | Roberts | H01R 12/79 439/496 |
| 7,232,334 | B2 * | 6/2007 | Shimizu | H01R 12/771 439/493 |
| 7,320,617 | B1 * | 1/2008 | Bellato | H01R 12/62 439/496 |
| 2002/0142647 | A1 * | 10/2002 | Aoki | H01R 12/85 439/496 |
| 2003/0016509 | A1 | 1/2003 | Tsukamoto | |
| 2006/0286859 | A1 * | 12/2006 | Shimizu | H01R 12/771 439/496 |

FOREIGN PATENT DOCUMENTS

| | | | |
|---|---|---|---|
| JP | 2003-123880 | A | 4/2003 |
| JP | 2007-004987 | A | 1/2007 |
| JP | 2011-076857 | A | 4/2011 |

* cited by examiner

CABLE HOLDING MEMBER, PLUG CONNECTOR, CONNECTOR DEVICE, FLAT CABLE, AND METHOD FOR ASSEMBLING PLUG CONNECTOR

RELATED APPLICATIONS

This application is the U.S. National Phase under 35 U.S.C. §371 of International Application No. PCT/JP2015/000085, filed on. Jan. 9, 2015, which in turn claims the benefit of Japanese Application No. 2014-002650, filed on Jan. 9, 2014, the disclosures of which are incorporated by reference herein.

TECHNICAL FIELD

The present invention generally relates to cable holding members, plug connectors, connector devices, flat cables, and methods for assembling the plug connectors. Specifically, the present invention relates to a cable holding member for holding a flat cable in a strip shape, a plug connector using the cable holding member, a connector device including the plug connector, a flat cable held by the cable holding member, and a method for assembling the plug connector.

BACKGROUND ART

In the past, there has been proposed an electrical connection device to be connected to a housing supporting multiple terminals so as to electrically interconnect multiple conductors of a flat cable to corresponding ones of the multiple terminals (e.g., disclosed in JP 2007-4987 A (hereinafter referred to as "Document 1")).

The electrical connection device disclosed in Document 1 is assembled by engaging a cable holder holding a flat cable with an engagement housing.

The cable holder includes a cable supporting part for supporting an exposed conductor of the flat cable in a folded state, and a tentative holding part attached to the cable supporting part in a rotative manner. An end of the flat cable is placed between the cable supporting part and the tentative holding part, and then the tentative holding part is rotated to a position in which the end of the flat cable is sandwiched between the cable supporting part and the tentative holding part. Thereby, the end of the Out cable is held. The flat cable is supported on the cable supporting part while the end is held by the tentative holding part, and the cable supporting part supporting the flat cable is fitted into the engagement housing. Thereby, the flat cable is fixed while being supported on the cable supporting part.

In the electrical connection device disclosed in Document 1, the flat cable is held by a hand to perform a process of winding the flat cable around the cable holder. Since the flat cable is thin and soft, it has been difficult to perform the process while optimally positioning the flat cable on the cable holder, and the process has thus been complicated.

SUMMARY OF INVENTION

In view of the above insufficiency, the objective of the present invention would be to propose a cable holding member facilitating an attachment process of a flat cable, a plug connector, a connector device, a flat cable, and a method for assembling the plug connector.

A cable holding member of the present invention includes a stopper member and a housing. The stopper member has an attachment surface on which a flat cable in a strip shape is to be attached in a folded state. The housing includes a housing space for housing the stopper member, a mounting surface which is provided at an opening edge of the housing space and on which the flat cable is to be placed, and a positioning section for positioning the flat cable placed on the mounting surface. The housing is configured such that the stopper member and the flat cable are attachable to the housing with the flat cable being in a folded state. The folded state is achieved by pressing the flat cable placed on the mounting surface by inserting the stopper member into the housing space.

In the cable holding member, the positioning section is preferably a recess into which a protrusion protruding outwardly in a width direction of the flat cable from an edge of the flat cable is to be fitted.

In the cable holding member, the stopper member preferably has a stepped part protruding from the attachment surface to a side on which the flat cable is to be placed, the stepped part being configured to catch an engaged section of the flat cable.

In the cable holding member, the stopper member and the housing preferably have a direction control section configured to control an attachment direction of the stopper member to insert the stopper member into the housing space in a regular attachment direction.

In the cable holding member, the housing preferably has a curved surface part at a portion of the housing facing a surface of the flat cable at the opening edge of the housing space, the curved surface part having an opening width decreasing toward an interior of the housing space.

A plug connector connector of the present invention includes the above-described cable holding member, and the flat cable which is to be attached to the stopper member to be in a folded state and is to be partially inserted into the housing space of the housing.

In the plug connector, the flat cable preferably has a flexible structure at a portion at which the flat cable is folded by the stopper member, the flexible structure rendering the portion more flexible than a remaining portion of the flat cable.

In the plug connector, the flexible structure is preferably a penetrating part formed through the flat cable in a thickness direction of the flat cable.

In the plug connector, the stopper member preferably has a lug to be fitted into the penetrating part.

A connector device of the present invention includes: the above-described plug connector, and a receptacle connector which supports a terminal to electrically connect with an electric conductor of the flat cable and to which the plug connector is detachably connectable.

Preferably, the connector device further has the following configuration. The terminal has contact pieces provided in a pair and facing each other with a gap for receiving the flat cable being provided therebetween. Each of the contact pieces in the pair has a contact point to electrically contact with a conductive part on a surface of the flat cable. The contact point is formed by processing a metal plate to have a part coming into contact with the conductive part and having a thickness direction parallel to a thickness direction of the flat cable.

Preferably, the connector device further has the following configuration. The contact pieces in the pair are flexibly deformable in a direction in which the contact pieces in the pair face each other. The terminal includes: base parts provided in a pair and each having a plate shape and arranged parallel to the surface of the flat cable, and protection parts protruding from edges of the base parts in the pair parallel to a connection direction of the flat cable so as to be close to the flat cable. Each of the contact pieces in the pair is formed by bending an end in the connection direction of a corresponding one of the base parts in the pair to be surrounded by the corresponding one of the base parts in the pair and the protection part.

In the connector device, a distance between the contact pieces in the pair preferably decreases as a distance from a part at which each of the contact pieces in the pair is connected to the base part to the contact point decreases.

A flat cable of the present invention includes a substrate having a strip shape. The substrate is foldable by the stopper member of the above-mentioned cable holding member. The substrate has a flexible structure at a portion at which the substrate is folded by the stopper member, the flexible structure rendering the portion more flexible than a remaining portion of the substrate.

In the flat cable, the flexible structure is preferably a penetrating part formed through the substrate in a thickness direction of the substrate.

A method for assembling the plug connector of the present invention includes: placing the flat cable on the mounting surface to straddle an opening edge of the housing space of the housing with the flat cable being positioned by the positioning section; inserting the stopper member into the housing space while a top end of the stopper member presses the flat cable placed on the mounting surface into the housing space; and stopping the inserting the stopper member when the stopper member is inserted into the housing space to a position at which the stopper member is locked in the housing by a lock structure provided to the stopper member and the housing.

When the flat cable is placed on the mounting surface of the housing, the flat cable is positioned by the positioning section with respect to the housing. In this state, when the stopper member is inserted into the housing space, the flat cable is pressed by the stopper member to be in a folded state along the attachment surface. In this state, the stopper member and the flat cable are attached to the housing. Therefore, it is possible to realize a cable holding member, a plug connector, a connector device, and a method for assembling the plug connector which do not require directly folding the flat cable by hand in attaching the flat cable, thereby facilitating the assembling process of the plug connector.

BRIEF DESCRIPTION OF DRAWINGS

Preferable embodiments according to the present invention will be described in more detail. Other features and advantages of the present invention will be better understood with reference to the following detailed description and the attached drawings.

DESCRIPTION OF EMBODIMENT

Figure 1A:
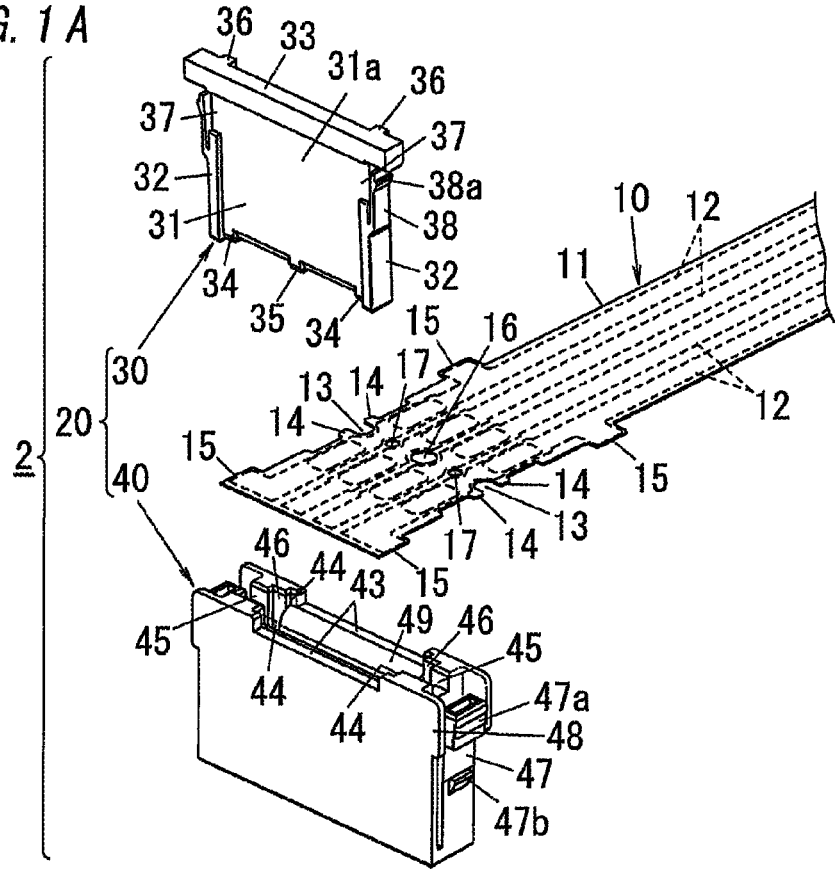
FIG. 1A is a perspective view illustrating a plug connector of the present embodiment in a step in an assembling process.

The following description referring to the drawings is made to a cable holding member, a plug connector including this cable holding member, and a connector device including this plug connector and a receptacle connector, which are of an embodiment of the present invention. Unless otherwise noted, the description is given on the basis of directions denoted by arrows shown in FIG. 8, but directions of the connector device in use are not limited to the above directions.

Figure 6A:
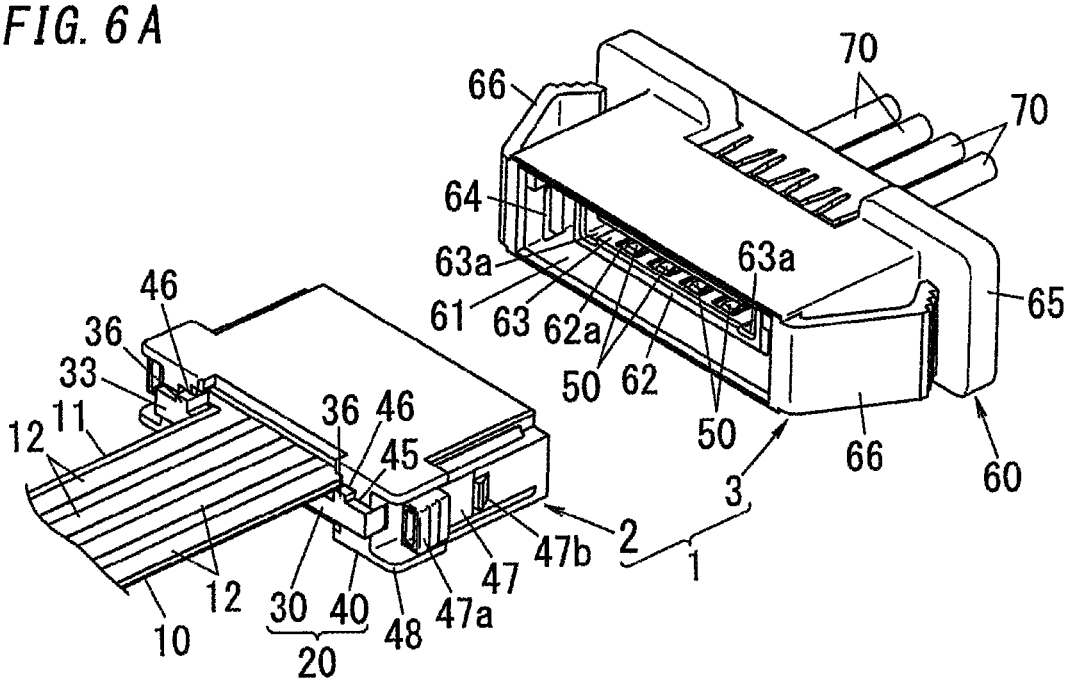
FIG. 6A is a rear perspective view illustrating the plug connector and a receptacle connector of the present embodiment in a separated state.
Figure 6B:
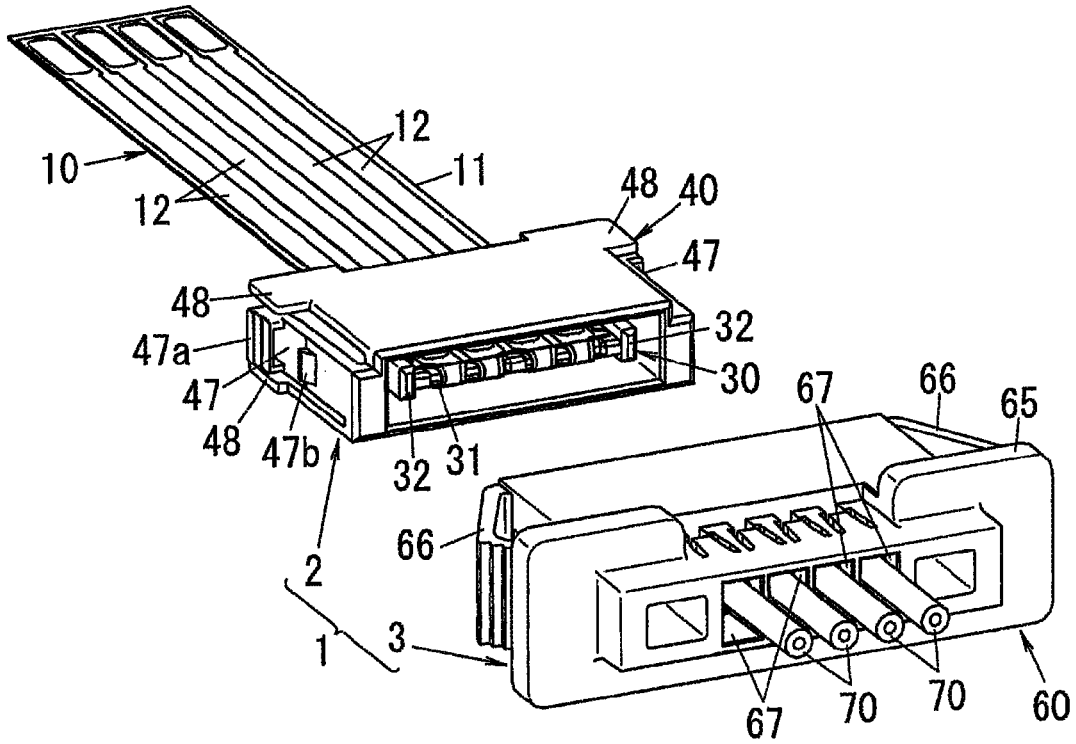
FIG. 6B is a front perspective view illustrating the plug connector and the receptacle connector of the present embodiment in a separated state.
Figure 8:
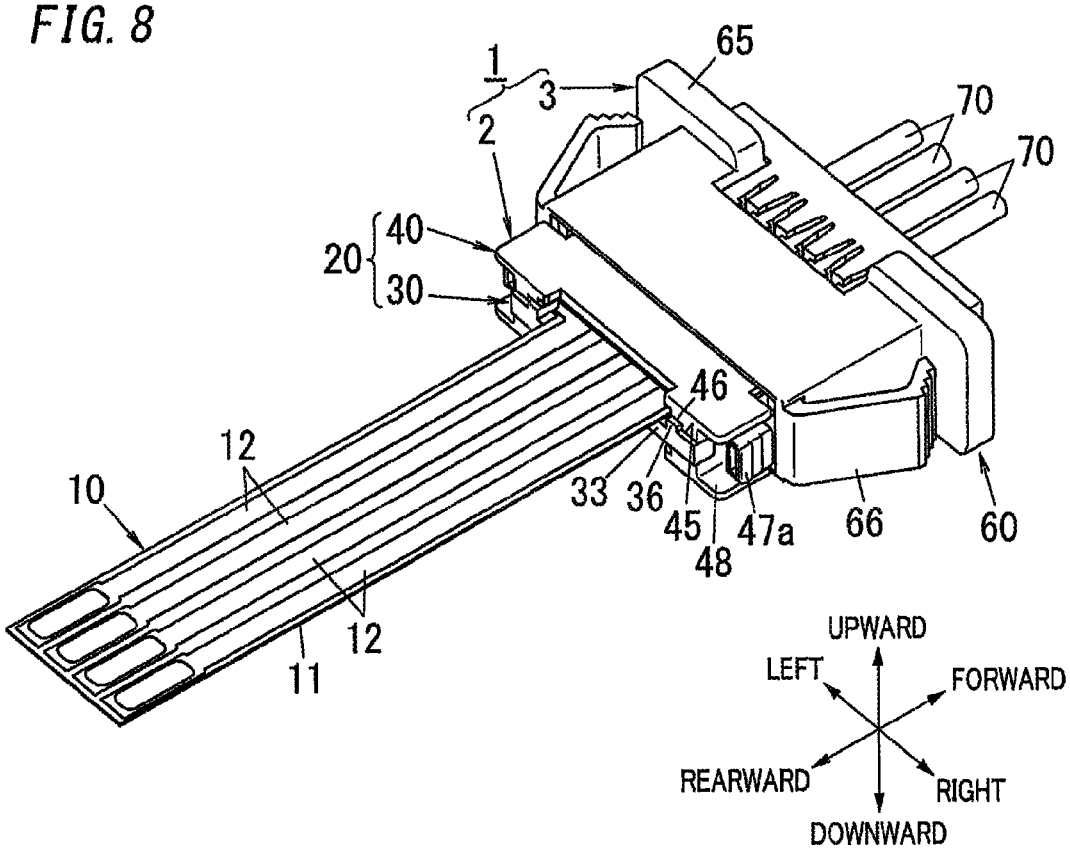
FIG. 8 is an external perspective view illustrating the plug connector and the receptacle connector of the connector device of the present embodiment in a connected state.

As illustrated in FIG. 6A, FIG. 6B, and FIG. 8, a connector device 1 of the present embodiment includes a plug connector 2 including a flat cable 10 and a cable holding member 20, and a receptacle connector 3 to which the plug connector 2 is removably connectable. The connector device 1 may be applied to, for example, Light Emitting Diode (LED) head lamps of vehicles, hut the application of the connector device 1 is not limited to this example. The receptacle connector 3 described in the present embodiment is to be connected to an electric cable, but may be used for substrate connection (may be a so-called Surface Mount Device (SMD) type) which is to be mounted on a printed wiring board by surface mounting.

Figure 5:
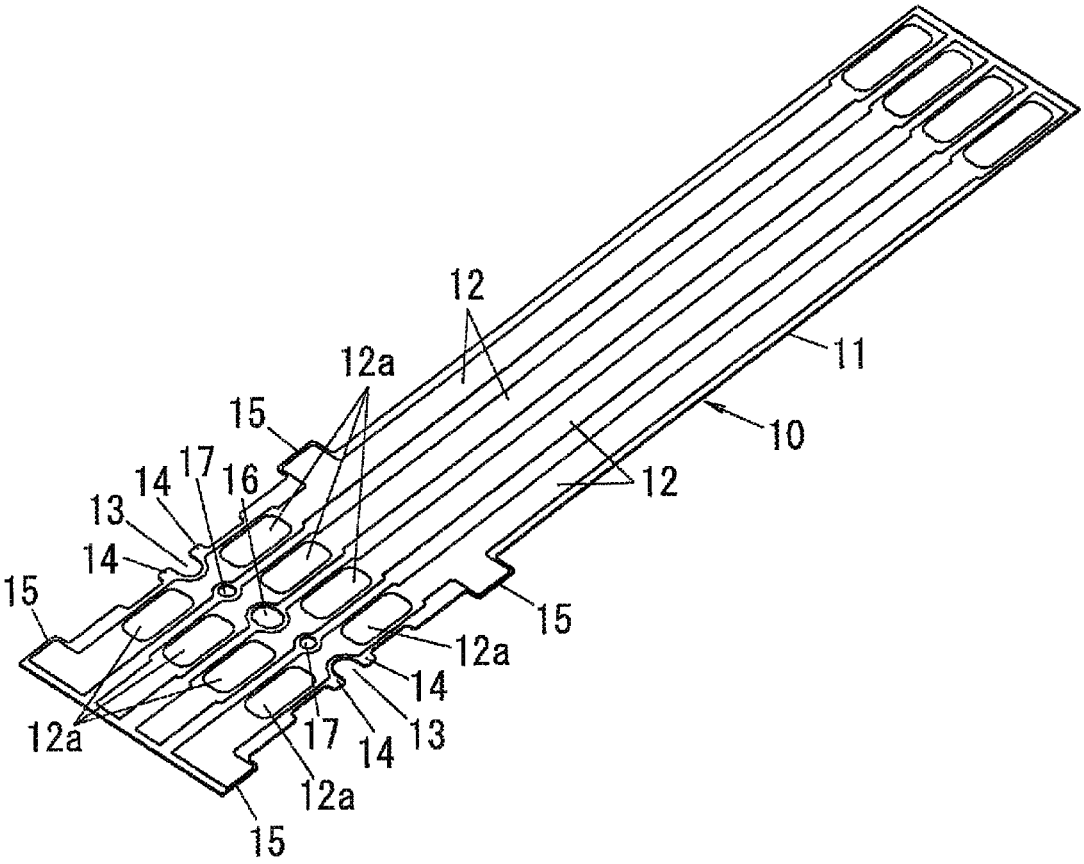
FIG. 5 is an external perspective view illustrating a flat cable used for the plug connector of the present embodiment.

As shown in FIG. 5, the flat cable 10 is made of for example, a Flexible Printed Circuit (FPC) board. The flat cable 10 includes a substrate 11 which is formed in an elongated film shape and is made of an insulating resin material. Note that the flat cable 10 is not limited to a flexible printed circuit board, but may be a flexible flat cable.

Multiple (in the present embodiment, four) electric conductors 12 are formed on a front surface of the substrate 11. The electric conductors 12 each individually form a conducting path. Each of the multiple electric conductors 12 is formed in a strip shape extending along a length direction of the substrate 11 by patterning a thin film of an electrically conductive material formed on the front surface of the substrate 11. The multiple electric conductors 12 are arranged at almost the same intervals in a width direction of the substrate 11.

Each edge in the width direction of the substrate 11 has a semicircular recess 13 provided to one end in the length direction of the substrate 11. Multiple (in the embodiment shown in the figure, two) protrusions 14 are provided to each edge in the width direction of the substrate 11 to protrude outward in the width direction from both sides of the recess 13 in the length direction of the substrate 11. Multiple (in the embodiment shown in the figure, two) lugs 15 (engaged sections) are provided to each edge in the width direction of the substrate 11 to protrude outward in the width direction from positions spaced substantially the same distance from the recess 13 in the length direction. The lugs 15 protrude beyond the protrusions 14.

In the substrate 11, a round through hole 16 is formed at a substantially middle position between the recesses 13 on both sides in the width direction of the substrate 11. Multiple (in the embodiment illustrated in the figure, two) round through holes 17 are provided between the through hole 16 and the both recesses 13. Each through hole 17 has a smaller diameter than the through hole 16. The portion of the substrate 11 provided with the recesses 13 and the through holes 16, 17 has higher flexibility than a remaining portion in the length direction of the substrate 11, and therefore, the substrate 11 is easily folded at this portion.

A reinforcing part formed in a film shape and made of an insulating synthetic resin such as a polyimide resin is attached to the front surface of the substrate 11. The electric conductors 12 are covered with this reinforcing part. The reinforcing part is provided with openings for exposing parts of the electric conductors 12 to be in contact with terminals 50 of the receptacle connector 3. The parts of the electric conductor 12 exposed via the openings serve as contacts 12*a* to electrically connect with the terminals 50. In the present embodiment, each electric conductor 12 has two contacts 12*a*. In the length direction of the substrate 11, the two contacts 12*a* of each electric conductor 12 are located at the substantially same distance from the recesses 13 with the position where the recesses 13 are formed being sandwiched therebetween. A plating layer of gold is preferably formed on the front surface of the contact 12*a*. This may lead to an increase in reliability of electrical contact.

The cable holding member 20 includes a stopper member 30 and a housing 40.

The stopper member 30 is a molded product made of an insulating synthetic resin as illustrated in FIG. 1A, FIG. 1B, FIG. 7, FIG. 9. The stopper member 30 integrally includes a supporting part 31 in a rectangular plate shape, a pair of guide walls 32 provided on both side portions in the width direction (left and right direction) of the supporting part 31, and an fitting part 33 provided to a rear end (upper end in FIG. 1A) of the supporting part 31.

The supporting part 31 has a rectangular plate shape. The supporting part 31 has an upper face and a lower face which constitute an attachment surface 31*a*, supporting the flat cable 10 in a state in which the flat cable 10 is folded in a U-shape. The supporting part 31 has a front end (lower end in FIG. 1A) provided with multiple lugs 34 each of which is to be inserted into a corresponding one of the multiple recesses 13 of the flat cable 10 and a lug 35 which is to be inserted into the through hole 16.

The pair of guide walls 32 has a shape protruding upward and downward from the left and right side portions of the supporting part 31. The distance between the pair of guide walls 32 (the left and right guide walls 32) is slightly larger than the width dimension of the flat cable 10 (the maximum dimension of the flat cable 10 except for the lugs 15).

The fitting part 33 has a square-pillar shape protruding upward and downward from the rear end of the supporting part 31. The fitting part 33 has a larger width than the supporting part 31 in left and right direction (in the width direction of the supporting part 31). The fitting part 33 has a surface provided with two lugs 36 on its left and right portions to restrict the fitting direction, thereby preventing the stopper member 30 from being inserted into a housing space 41 with the stopper member 30 being reversed. Between the fitting part 33 and the left and right guide walls 32, recesses 37 are provided into which the lugs 15 of the flat cable 10 are to be inserted. The lug 15 inserted into each recess 37 is caught by a corresponding one of the guide walls 32. The guide walls 32 protrude from the attachment surface 31*a* to aside where the flat cable 10 is provided, and the guide walls 32 form step portions which catch the engaged sections (lugs 15) of the flat cable 10.

Further, each of the left and right guide walls 32 is provided with a slit to form a movable piece 38. The slit has an open rear end, and the movable piece 38 is flexible in the left and right direction (in the width direction of the supporting part 31). The movable piece 38 is provided with a lug 38*a* protruding therefrom outward in the left and right direction. The lug 38*a* is tapered toward its rear end so as to increase its outward projection amount.

Next, the housing 40 will be described with reference to FIG. 3, FIG. 4A, FIG. 4B, FIG. 4C, and FIG. 4D.

The housing 40 is a molded product made of an insulating synthetic resin. The housing 40 has a cuboidal shape having a dimension larger in the left and right direction (the length direction of the housing 40 orthogonal to an insertion direction into which the stopper member 30 is inserted into the housing 40 and to the width direction) than in the upward and downward direction (the short direction of the housing 40 orthogonal to the insertion direction). The housing 40 has the housing space 41 into which the stopper member 30 is to be inserted.

Figure 7:
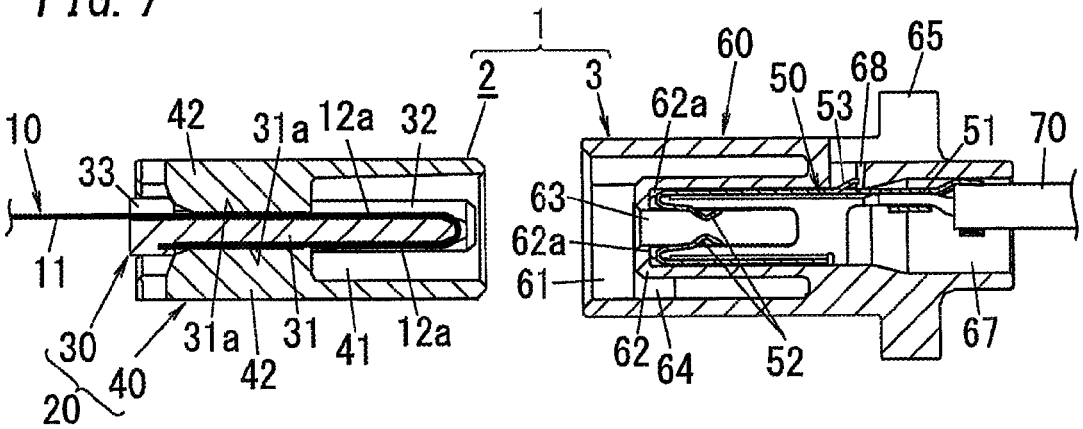
FIG. 7 is a sectional view illustrating the plug connector and the receptacle connector of a connector device of the present embodiment in a separated state.
Figure 9:
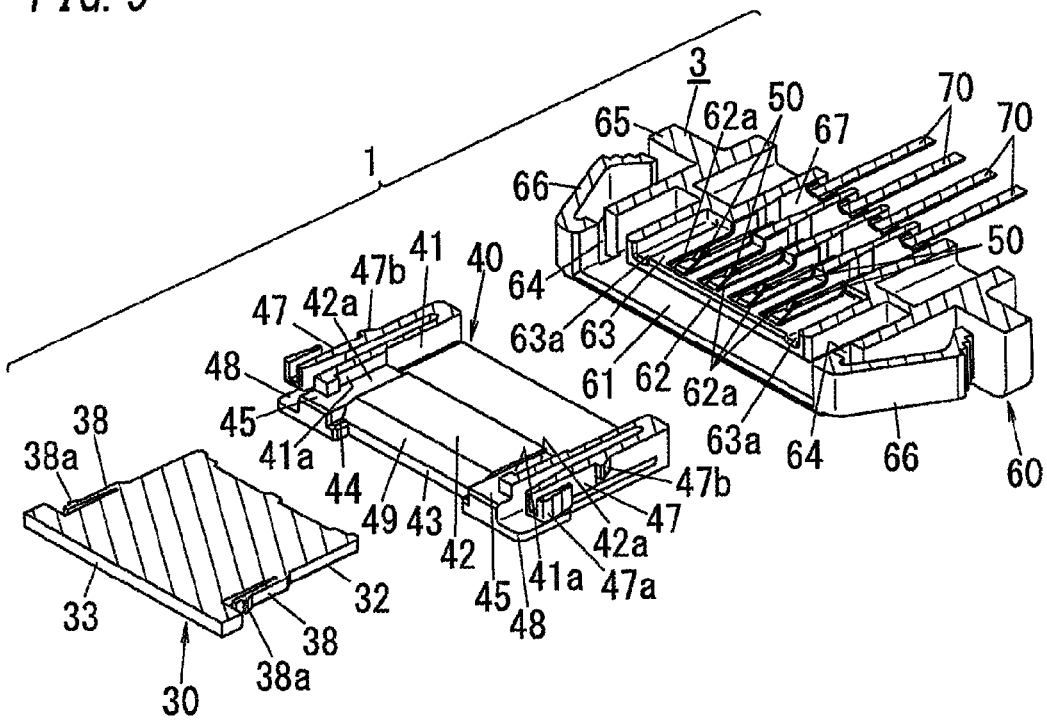
FIG. 9 is a sectional perspective view illustrating the connector device of the present embodiment in a disassembled state seen from above.
Figure 10:
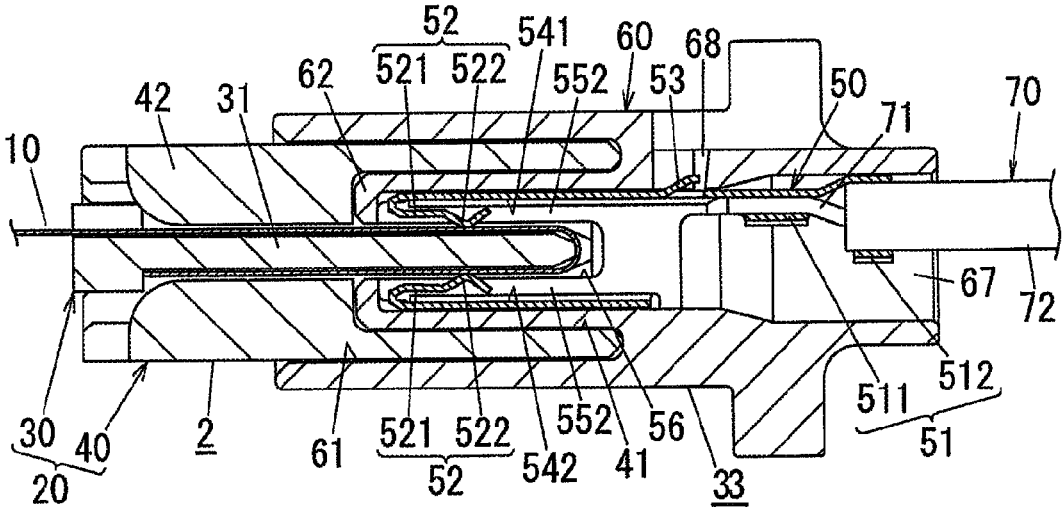
FIG. 10 is a sectional view illustrating the plug connector and the receptacle connector of the present embodiment in a connected state.
Figure 11A:
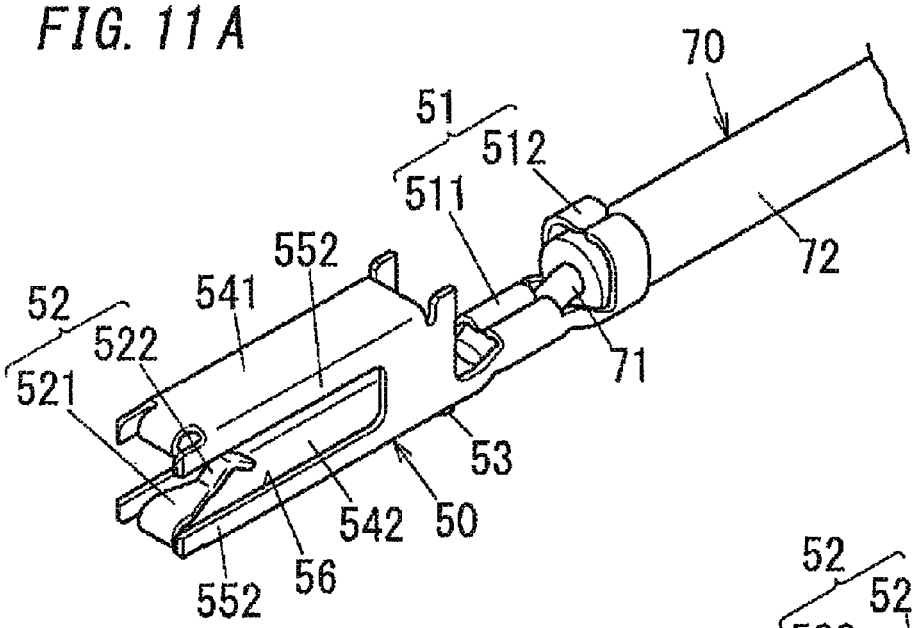
FIG. 11A is an external perspective view illustrating a terminal and a cable of the present embodiment in a connected state seen from the rear side.
Figure 11B:
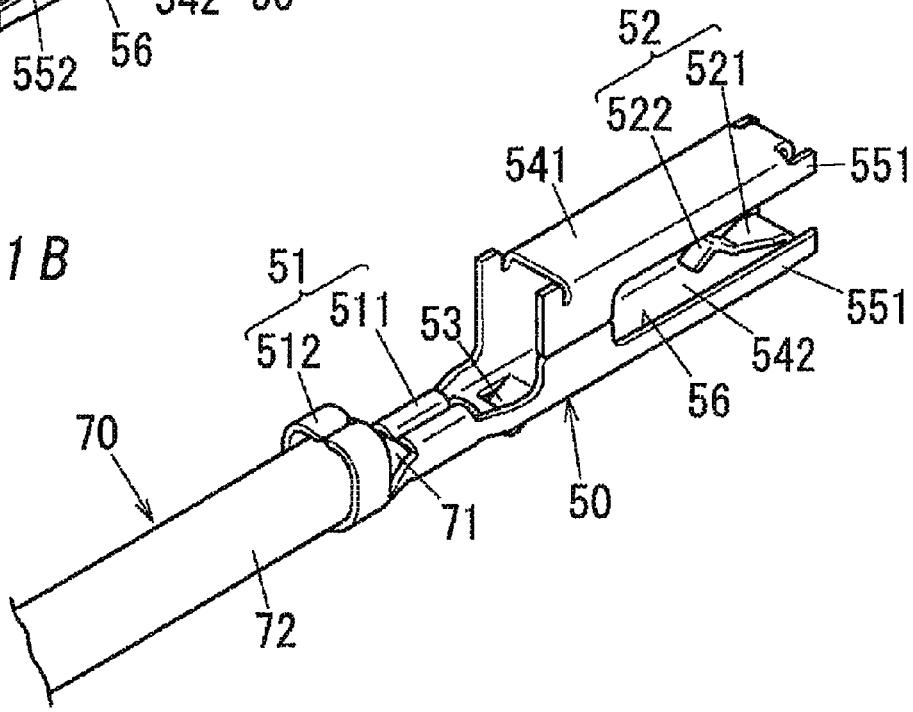
FIG. 11B is an external perspective view illustrating the terminal and the cable of the present embodiment in the connected state seen from the front side.
Figure 12:
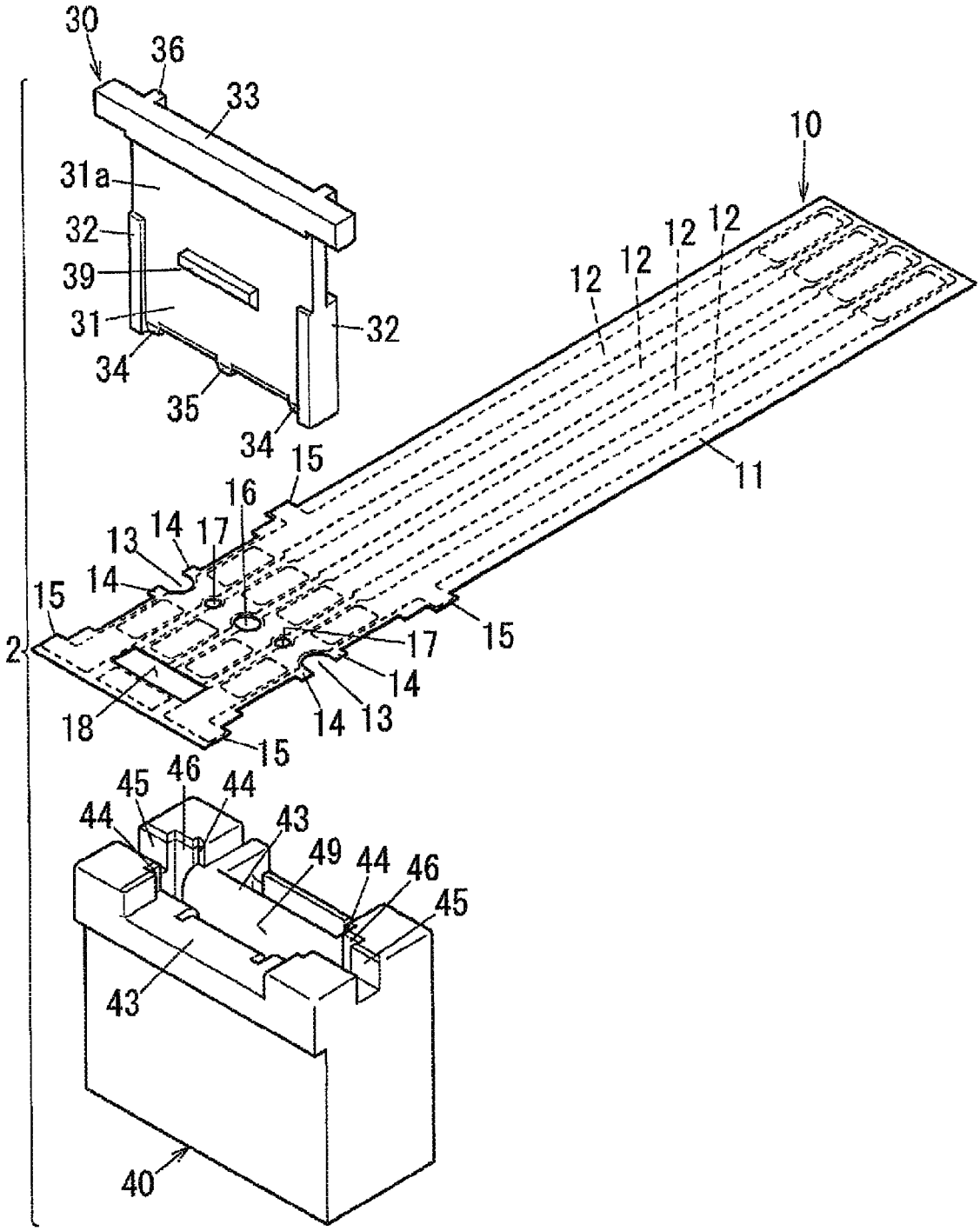
FIG. 12 is an exploded perspective view illustrating a variation of the plug connector of the present embodiment.

The dimension of the internal space in the upward and downward direction (in the short direction of the housing 40) is smaller at a rear part of the housing space 41 (substantially a half of the housing space 41 on a side facing an insertion port via which the flat cable 10 is to be inserted) than at a front part of the housing space 41 due to inside walls 42 protruding into the housing space 41 from an inner surface to form a table shape (see FIG. 7 and FIG. 9). Left and right side portions of the inside wall 42 have rail grooves 42*a* which extend along the forward and rearward direction (insertion direction) and to which the guide walls 32 of the stopper member 30 are to be inserted.

The housing space 41 has openings both in a front surface and in a rear surface of the housing 40. Through the opening in the rear surface of the housing 40, the stopper member 30 is to be inserted into the housing space 41. Mounting surfaces 43 each having a width slightly larger than the flat cable 10 and being recessed with respect to the rear surface of the housing 40 (upper surface in FIG. 3) are provided at an opening edge on the rear side of the housing 40 (on the side facing the insertion port via which the flat cable 10 is to be inserted).

Figure 1B:
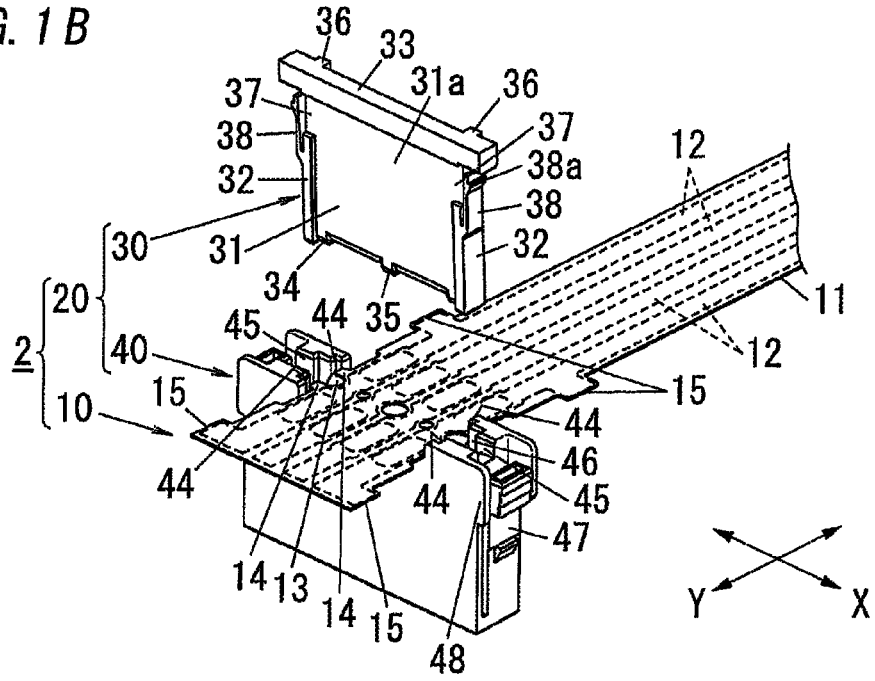
FIG. 1B is a perspective view illustrating the plug connector of the present embodiment in another step in the assembling process.

The opening edge on the rear side of the housing 40 has multiple (in the embodiment illustrated in the figure, four) recesses 44 into each of which a corresponding one of the multiple (in the embodiment illustrated in the figure, four) protrusions 14 of the flat cable 10 placed on the mounting surfaces 43 is to be fitted (see FIG. 1A, FIG. 1B).

Multiple (in the embodiment illustrated in the figure, two) fitting grooves 45 into which the fitting part 33 of the stopper member 30 is to be inserted are provided in the rear surface of the housing 40. Two recesses 46 are each provided in one end face (in FIG. 8, upper end face) of the fitting groove 45. Each of the two lugs 36, which are provided to the stopper member 30 an as to prevent the stopper member 30 from being attached to the housing 40 with the stopper member 30 being reversed, is to be inserted into a corresponding one of the recesses 46.

The housing 40 includes left and right side parts provided with movable pieces 47. Each movable piece 47 is connected to a body part of the housing 40 only at its front end. The movable piece 47 has a rear end movable in the left and right direction (in the length direction of the housing 40). The rear end of the movable piece 47 is provided with a manipulation part 47*a* for allowing pressing by hand protruding therefrom outward in the left and right direction (toward the opposite side of the housing 40 from the center of the housing 40 in the left and right direction). The movable piece 47 further has a lug 47*b* provided to a center of an external face of the movable piece 47 in the forward and rearward direction (insertion direction). The lug 47*b* protrudes outward in the left and right direction. The lug 47*b* is tapered toward its front end so as to reduce its outward projection amount. Note that from left and right side edges of the rear part of the housing 40, cover parts 48 extend to overlap the corresponding movable pieces 47 in the upward and downward direction (in the short direction of the housing 40). Each cover part 48 is provided so as to prevent unintentional press of the movable piece 47.

The inside wall of the housing space 41 of the housing 40 has multiple stepped parts 41*a* configured to engage with the multiple lugs 38*a* of the stopper member 30. Here, the lugs 38*a* and the stepped parts 41*a* form a lock structure for locking the stopper member 30 inserted into the housing space 41.

A method for assembling the plug connector 2 will be described with reference to FIG. 1A, FIG. 1B, FIG. 2A, FIG. 2B, and FIG. 3.

First, as illustrated in FIG. 1B, the flat cable 10 is placed on the mounting surfaces 43 of the housing 40 to straddle the opening edge of the housing space 41. Here, the flat cable 10 is placed on the mounting surfaces 43 such that the protrusions 14 of the flat cable 10 are inserted into the recesses 44 at the opening edge of the housing 40. In this state, side edges in the length direction of the flat cable 10 abut on wall parts rising from left and light sides of the mounting surfaces 43 of the housing 40, thereby positioning the flat cable 10 in the width direction (in the X direction in FIG. 1B). Moreover, the protrusions 14 each abut on an end face of the recess 44 of the housing 40, thereby positioning the flat cable 10 in the length direction (in the Y direction in FIG. 1B). That is, the flat cable 10 is positioned with respect to the housing 40 in the width direction and in the length direction.

Figure 2A:
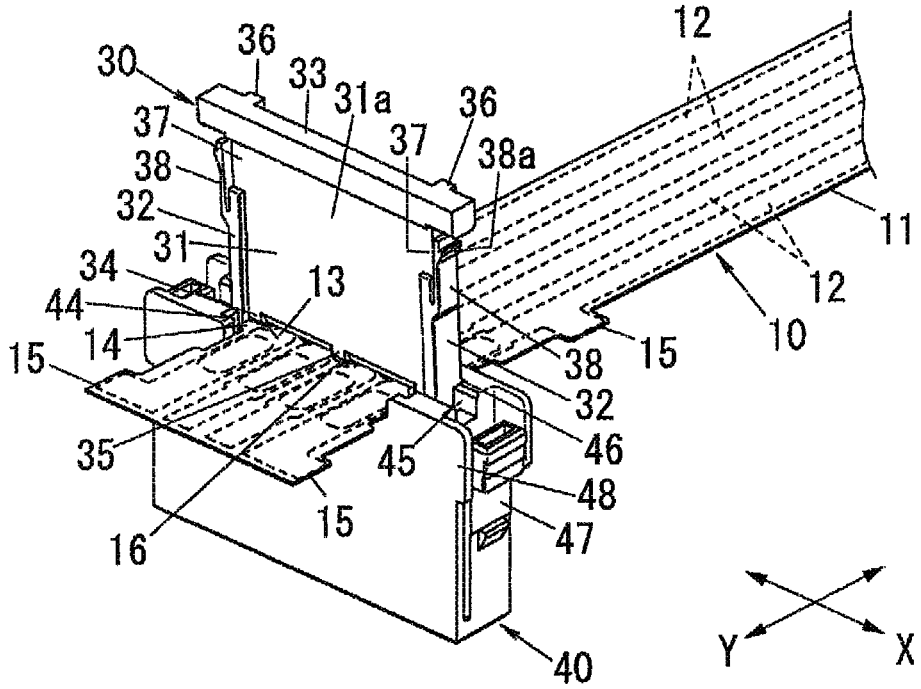
FIG. 2A is a perspective view illustrating the plug connector of the present embodiment in a step in the assembling process.

As illustrated in FIG. 1B, the flat cable 10 is placed on the mounting surfaces 43 of the housing 40, and then the stopper member 30 is brought close to the housing 40 from above, and as illustrated in FIG. 2A, the top end of the stopper member 30 is inserted into the housing space 41 of the housing 40. When the top end of the stopper member 30 is inserted into the fitting groove 45 to a position at which the top end abuts on the flat cable 10, the lugs 34 of the stopper member 30 are inserted into the recesses 13, and the lug 35 is inserted into the through hole 16. In this state, the guide walls 32 on left and right side edges of the stopper member 30 each abut on an end face of the recess 46 of the housing 40 in the X and Y directions in FIG. 2A, thereby positioning the stopper member 30 with respect to the housing 40 in the X and Y directions. The flat cable 10 is positioned with respect to the housing 40, and therefore, a position of the flat cable 10 at which the flat cable 10 is to be folded by the stopper member 30 is defined.

Figure 2B:
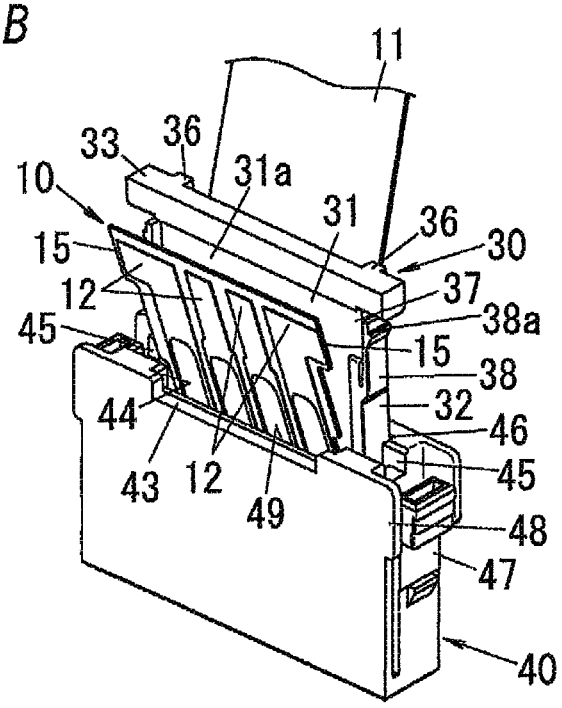
FIG. 2B is a perspective view illustrating the plug connector of the present embodiment in another step in the assembling process.

Starting from the state in which the stopper member 30 is set on the housing 40, the stopper member 30 is pressed into the housing 40 as illustrated in FIG. 2B. At this time, the stopper member 30 presses the flat cable 10, thereby folding the flat cable 10.

Figure 3:
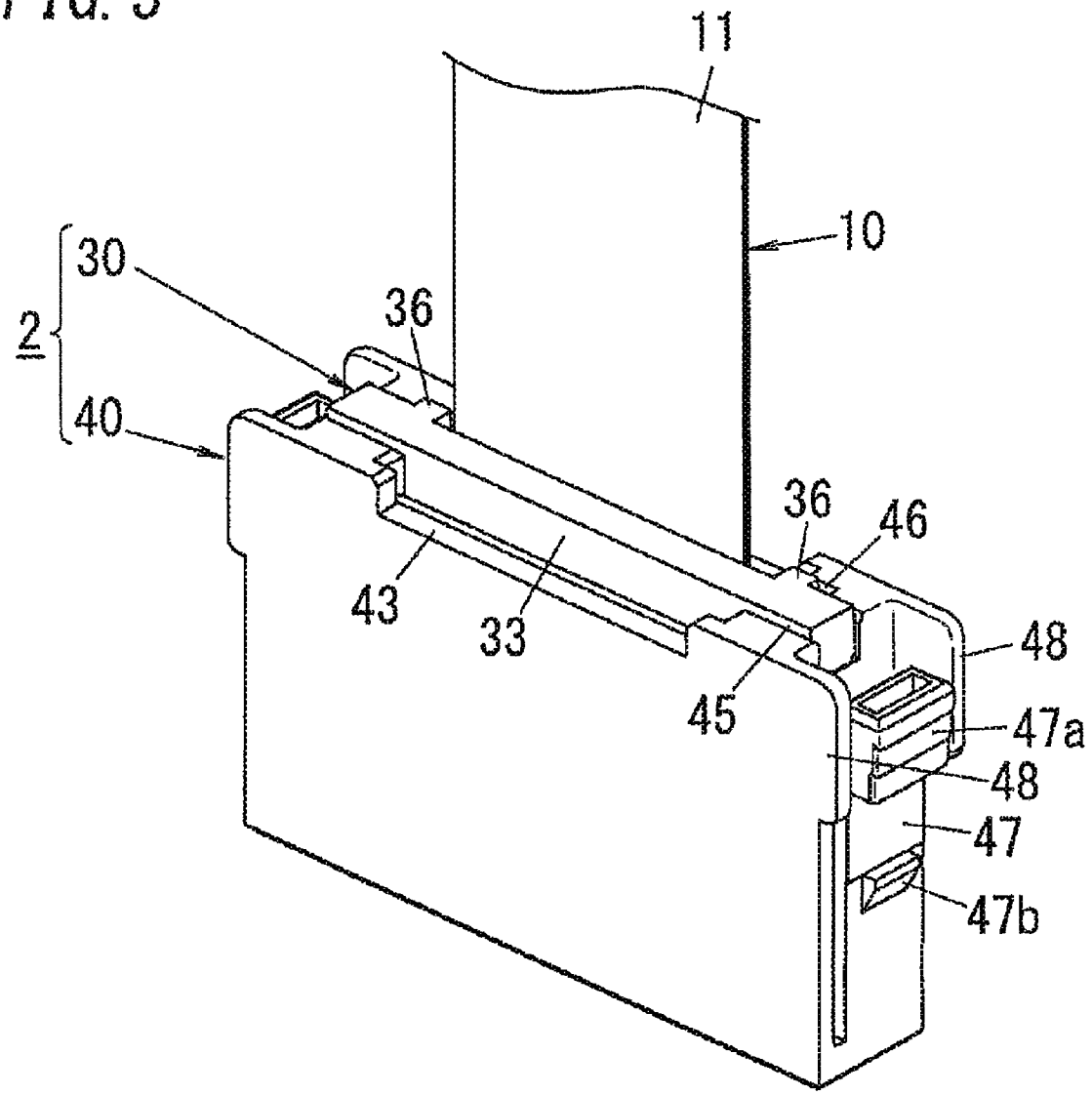
FIG. 3 is an external perspective view illustrating the plug connector of the present embodiment.
Figure 4D:
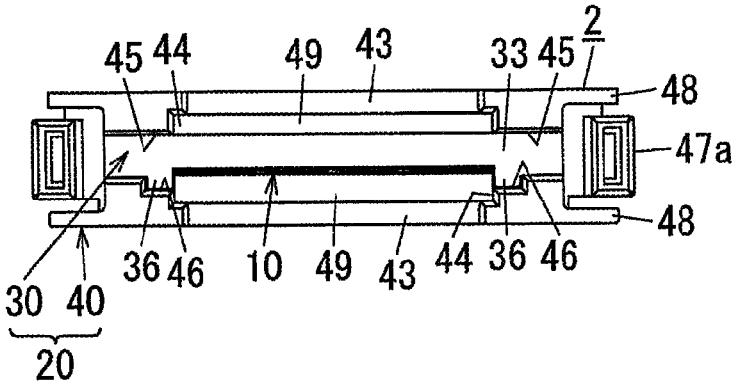
FIG. 4D is a side view illustrating the plug connector of the present embodiment seen from the rear side.
Figure 4B:
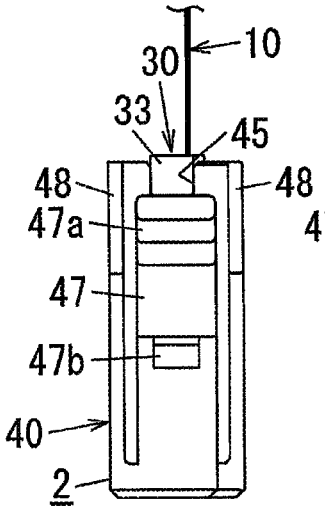
FIG. 4B is a side view illustrating the plug connector of the present embodiment seen from the left side.
Figure 4A:
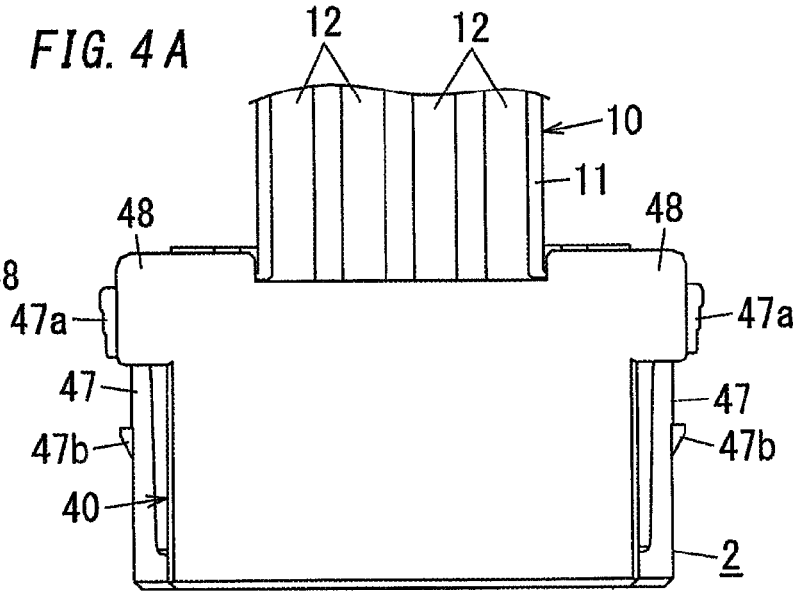
FIG. 4A is a front view illustrating the plug connector of the present embodiment.
Figure 4C:
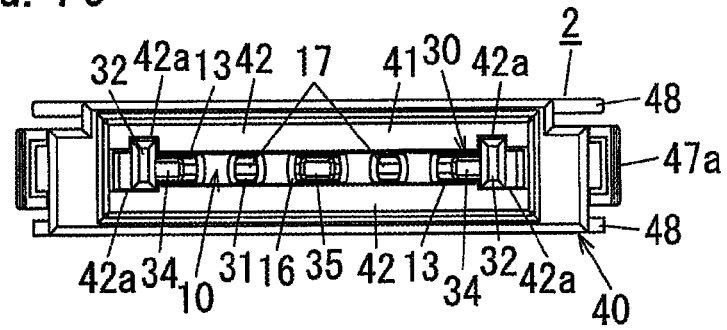
FIG. 4C is a side view illustrating the plug connector of the present embodiment seen from the front side.

As illustrated in FIG. 3, the stopper member 30 is pressed into the housing 40 to a defined position. Then, as illustrated in FIG. 7, a state in which the flat cable 10 is attached to the attachment surfaces 31*a* is achieved with the stopper member 30 being folded into a U-shape along the attachment surfaces 31*a*. When the stopper member 30 is pressed to a defined position, the lugs 38*a* of the stopper member 30 engage with the stepped parts 41*a* of the inside wall of the housing 40, thereby locking the stopper member 30 with the stopper member 30 being inserted in the housing 40, and the assembling process of the plug connector 2 ends.

Here, the method for assembling the plug connector 2 is summarized. The method includes the following first, second, and third steps. The first step is a step of placing the flat cable 10 on the mounting surfaces 43 to straddle the opening edge of the housing space 41 of the housing 40 with the flat cable 10 being positioned by the positioning sections (the recesses 44). The second step is a step of inserting the stopper member 30 into the housing space 41 while the flat cable 10 placed on the mounting surfaces 43 is pressed into the housing space 41 by the top end of the stopper member 30. The third step is a step of stopping the inserting the stopper member 30 when the stopper member 30 is inserted into the housing space 41 to a position at which the stopper member 30 is locked in the housing 40 by the lock structure (the lugs 38*a* and the stepped parts 41*a*) provided to the stopper member 30 and the housing 40.

When the plug connector 2 has been assembled, the fitting part 33 abuts on the end face of the fitting groove 45, and the lugs 38*a* of the stopper member 30 engage with the stepped parts 41*a* provided to the inside wall of the housing 40, thereby positioning the stopper member 30 with respect to the housing 40 in the forward and rearward direction (insertion direction). The flat cable 10 is held by the cable holding member 20 including the stopper member 30 and the housing 40 with the flat cable 10 being supported on the attachment surface 31*a* of the stopper member 30. Note that each part is dimensioned such that when the stopper member 30 is attached to the housing 40, the front end of the stopper member 30 faces the opening in the front surface of the housing 40, but the front end of the stopper member 30 does not protrude beyond the front surface of the housing 40.

Next, the receptacle connector 3 to which the plug connector 2 of the present embodiment is detachably connectable will be described with reference to FIG. 6A, FIG. 6B, and FIG. 7 to FIG. 9.

The receptacle connector 3 includes multiple (for example, four) terminals 50 for electrically connecting with multiple (in the present embodiment, four) electric cables 70, and a housing 60 for supporting the multiple terminals 50.

The housing 60 is a molded product made of an insulating synthetic resin and is in a hollow cuboidal shape with an open rear face (rear face in FIG. 8) defining an insertion opening 61 into which the plug connector 2 is to be inserted. The housing 60 has a front wall from whose internal face a hollow cuboidal part 62 protrudes rearward to be fitted into an opening in the front face of the plug connector 2. The cuboidal part 62 has an end face in which a fitting hole 63 is formed. The fitting hole 63 is in a slit shape to receive front part of the stopper member 30. The fitting hole 63 has left and right sides provided with opening parts 63*a*. The wide opening parts 63*a* are longer in a dimension in the upward and downward direction (short direction of the housing 60) than central part of the fitting hole 63 in the left and right direction (length direction of the housing 60). The guide walls 32 of the stopper member 30 are inserted into the wide opening parts 63*a*. The housing 60 has a left side wall and a right side wall each provided with a hole 64. The holes 64 receive and hold the lugs 47*b* of the plug connector 2.

The housing 60 has a rear part from whose outer periphery a flange 65 protrudes. Further, a pair of engaging pieces 66 by which the housing 60 is attached to an attachment panel is provided integrally with front ends of the left and right side walls of the housing 60.

The hollow cuboidal part 62 of the housing 60 supports the multiple terminals 50 individually corresponding to the multiple electric conductors 12 of the flat cable 10 attached to the stopper member 30.

Each terminal 50 is formed by bending a metal plate, and includes, as illustrated in FIG. 7, an electric cable connecting part 51 for swaging and fixing a core cable of the electric cable 70 and a pair of contacts 52 which are formed integrally.

The contacts 52 are arranged on an upper side and on a bottom side in the cuboidal part 62 to face each other and have rear ends (ends on the left side in FIG. 7) serving as fixed ends. The contacts 52 are formed by bending so as to incline to be close to each other toward their front end (the right side in the FIG. 7). The pair of contacts 52 is flexible in the upward and downward direction (in a direction in which the contacts 52 face each other). The contacts 52 hold the flat cable 10 attached to the stopper member 30 from above and below and come into elastic contact with any of the multiple electric conductors 12 (contacts 12*a*) of the flat cable 10.

The hollow cuboidal part 62 has multiple (for example, four) grooves 62*a* formed in an upper side face and a lower side face facing the fitting hole 63 of the hollow cuboidal part 62, and the terminals 50 are situated in the grooves 62*a* one-by-one. Multiple holes 67 each communicating with a corresponding one of the grooves 62*a* are open in the front wall of the housing 60.

Each terminal 50 is inserted into the groove 62*a* via any one of the holes 67 after the electric cable 70 is connected to the terminal 50. When the terminal 50 is inserted to a predetermined position, a barb 53 formed by cutting and bending a part of the terminal 50 engages with a hole 68 of the housing 60, thereby holding the terminal 50 placed in the groove 62*a*. In the state in which the terminal 50 is placed in the groove 62*a*, the pair of contacts 52 of the terminals 50 face each other in the upward and downward direction with the fitting hole 63 in-between. In this way, when the stopper member 30 to which the flat cable 10 has been attached in a folded state is inserted into the fitting hole 63, the pair of contacts 52 of each terminal 50 comes into contact with the contacts 12*a* of a corresponding one of the electric conductors 12, thereby electrically connecting the electric conductor 12 to a corresponding one of the electric cables 70.

The connector device 1 of the present embodiment has the aforementioned configuration, and the plug connector 2 is attached to or detached from the receptacle connector 3 in the following manners.

The housing 40 of the plug connector 2 is inserted into the insertion opening 61 of the housing 60 of the receptacle connector 3, thereby inserting the cuboidal part 62 of the housing 60 into the opening in the front surface of the housing 40. In this regard, the front part of the stopper member 30 is inserted into the fitting hole 63 of the cuboidal part 62, and the flat cable 10 attached to the upper and lower faces of the supporting part 31 is inserted between the pair of contacts 52. The multiple pairs of contacts 12*a* are provided to parts of the flat cable 10 to be situated on the upper face and the lower face of the supporting part 31, and the pair of contacts 52 is in contact with the pair of contacts 12*a* from above and below, thereby electrically connecting each of the terminals 50 to a corresponding one of the electric conductors 12. Further, when the housing 40 is inserted into the insertion opening 61 of the housing 60 to a predetermined position, the lugs 47*b* on both left and right side parts of the housing 40 engage with the holes 64 of the housing 60. In this way, connection between the plug-connector 2 and the receptacle connector 3 is maintained.

To detach the plug connector 2 from the receptacle connector 3, the left and right manipulation parts 47*a* provided to the housing 40 are pinched to deform the movable pieces 47 inward. This allows the lugs 47*b* on the left and right side parts of the housing 40 to go out of the holes 64, thereby releasing the engagement of the lugs 47*b* with the holes 64. In this state, the housing 40 can be detached from the housing 60 by pulling the housing 40 rearward. Apparently, it is possible to easily detach the plug connector 2 from the receptacle connector 3.

As described above, the housing 40 includes the mounting surfaces 43 which are provided at the opening edge of the housing space 41 and on which the flat cable 10 is to be placed, and the positioning sections (the recesses 44) for positioning the flat cable 10 placed on the mounting surfaces 43. When the flat cable 10 is placed on the mounting surfaces 43 of the housing 40, the flat cable 10 is positioned by the positioning sections with respect to the housing 40. In this state, when the stopper member 30 is inserted into the housing space 41, the flat cable 10 is pressed by the stopper member 30, and the stopper member 30 and the flat cable 10 are attached to the housing 40 with the flat cable 10 being folded along the attachment surface 31*a*. Thus, when the Out cable 10 is attached to the cable holding member 20, it is not necessary to bend the flat cable 10 directly by hands. Thus, the assembling process is facilitated. In the present embodiment, the positioning sections include the protrusions 14 protruding outward in the width direction from the edges of the flat cable 10 and the recesses 44 into which the protrusions 14 are to be fitted. In the state in which the protrusions 14 are fitted into the recesses 44, the flat cable 10 is placed on the mounting surfaces 43, thereby positioning the flat cable 10 with respect to the housing 40.

The stepped parts (guide walls 32) of the stopper member 30 catch the engaged sections (lugs 15) of the flat cable 10, and thus pull-out force acting on the flat cable 10 can be received by the stepped parts, thereby reducing positional displacement of the flat cable 10.

The lugs 36 of the stopper member 30 and the recesses 46 of the housing 40 form a direction control section for controlling an attachment direction of the stopper member 30 so as to insert the stopper member 30 into the housing space 41 in a regular attachment direction. That is, the direction control section includes the lugs 36 of the stopper member 30 and the recesses 46 of the housing 40. This reduces mistakes about the attachment direction of the stopper member 30. The regular attachment direction refers to a direction in which predetermined surfaces of the stopper member 30 and the housing 40 face each other when the stopper member 30 is inserted into the housing 40 in the upward and downward direction (in the width direction of the supporting part 31). That is, the regular attachment direction refers to a direction in which the surface of the stopper member 30 provided with the lugs 36 faces the surface of the housing 40 provided with the recesses 46. Note that the direction control section may include one lug of the stopper member 30 and one recess of the housing 40.

The housing 40 has a curved surface part 49 at a portion of the housing 40 facing the surface of the flat cable 10 at the opening edge of the housing space 41, the curved surface part having an opening width decreasing toward the interior of the housing space 41. When the flat cable 10 is placed on the mounting surfaces 43, and then the flat cable 10 is pressed into the housing space 41 by the stopper member 30, the flat cable 10 is folded along the curved surface part 49. Since the flat cable 10 is smoothly folded along the curved surface part 49, stress applied to the flat cable 10 at the time of bending the flat cable 10 can be reduced. Therefore, the flat cable 10 can be smoothly housed into the housing space 41.

The flat cable 10 has flexible structures at a portion of the substrate 11 at which the flat cable 10 is folded by the stopper member 30. The portion provided with the flexible structures is more flexible than a remaining portion. Therefore, when the flat cable 10 is folded, stress applied to the flat cable 10 can be reduced. Here, the flexible structures refer to penetrating parts (the recesses 13, the through holes 16, 17) formed through the flat cable 10 (substrate 11) in the thickness direction of the flat cable 10 (substrate 11). As the penetrating parts, the recesses 13 and the through holes 16, 17 are formed, thereby improving the flexibility of the flat cable 10. The shape and the number of the recesses 13 and the through holes 16, 17 are not limited to those illustrated in the present embodiment and can be accordingly changed as long as desired flexibility can be obtained. As the penetrating parts, only the recesses may be formed or only the through holes may be formed.

The stopper member 30 has lugs 34 to be fitted into the recesses 13 of the penetrating parts and the lug 35 to be fitted into the through hole 16 of the penetrating parts. The lugs 34, 35 are each fitted into a corresponding one of the penetrating parts, thereby positioning the flat cable 10 with respect to the stopper member 30. In this way, the stopper member 30 can be accommodated into the housing 40 while the stopper member 30 securely supports the flat cable 10.

Each of the terminals 50 supported by the receptacle connector 3 of the present embodiment is formed by bending a metal plate. As illustrated in FIG. 7, FIG. 10, FIG. 11A, and FIG. 11B, each terminal 50 further integrally includes base parts 541, 542 and protection parts 551, 552 in addition to the electric cable connecting part 51 and the pair of contacts 52 (contact pieces in a pair). The base parts 541, 542 each have a rectangular plate shape whose length direction is in the forward and rearward direction (connection direction of the flat cable 10). The base part 541 is disposed above the flat cable 10, and the base part 542 is disposed under the flat cable 10. The base parts 541, 542 are disposed parallel to the surface of the flat cable 10. The protection part 551 in a plate shape protrudes from a right edge of each of the base parts 541, 542 so as to be close to the flat cable 10, and the protection part 552 in a plate shape protrudes from a left edge of each of the base parts 541, 542 so as to be close to the flat cable 10. Slits 56 (gaps) having open rear ends are provided between the upper and lower protection parts 551 and between the upper and lower protection parts 552. The flat cable 10 attached to the stopper member 30 is to be inserted into the slits 56.

The upper one of the pair of contacts 52 is formed by bending a portion of the upper contact 52 protruding beyond the rear end of the base part 541 diagonally downward in the front direction. The upper contact 52 includes a flexible piece 521 protruding from the rear end of the base part 541 diagonally downward in the front direction and a contact point 522 provided at the top end of the flexible piece 521. The contact point 522 has a curved surface which is downwardly convex.

The lower one of the pair of contacts 52 is formed by bending a portion of the lower contact 52 protruding beyond the rear end of the base part 542 diagonally upward in the front direction. The lower contact 52 includes a flexible piece 521 protruding from the rear end of the base part 542 diagonally upward in the front direction and a contact point 522 provided at the top end of the flexible piece 521. The contact point 522 has a curved surface which is upwardly convex.

The contacts 52 in the pair face each other with the slits 56 for receiving the flat cable 10 being provided therebetween, and the contacts 52 are inclined so as to be close to each other toward their front ends. Each contact 52 is flexible in the upward and downward direction (in a direction in which the contact 52 comes into contact with the flat cable 10). When the flat cable 10 attached to the cable holding member 20 is inserted into the slits 56, the contact points 522 of the contacts 52 hold the flat cable 10 from above and below and come into elastic contact with the electric conductor 12 of the flat cable 10. In this way, a core cable 71 connected to the terminal 50 is electrically connected to the electric conductor 12 of the flat cable 10. Here, the pair of vertically disposed base parts 541, 542 and the pair of horizontally disposed protection parts 551, 552 form a cylindrical shape, and therefore the pair of contacts 52 are surrounded by the base parts 541, 542 and the protection parts 551, 552.

The electric cable connecting part 51 includes a swaged piece 511 for fixing the core cable 71 of the electric cable 70 by swaging, and a swaged piece 512 for fixing an insulating cover 72 of the electric cable 70 by swaging. The core cable 71 is fixed by swaging to the swaged piece 511 of the electric cable connecting part 51, and thereby the terminal 50 is electrically connected to the core cable 71. The insulating cover 72 is fixed by swaging to the swaged piece 512 of the electric cable connecting part 51, thereby mechanically fixing the insulating cover 72 of the electric cable 70 to the terminal 50, which reduces external force applied to the connecting part of the swaged piece 511 and the core cable 71.

As described above, in the receptacle connector 3 of the present embodiment, the terminal 50 may include contact pieces in a pair (in the present embodiment, the pair of contacts 52) facing each other with a gap (in the present embodiment, the slit 56) for receiving the flat cable 10 being provided therebetween. Each of the contact pieces in the pair includes the contact point 522 which is to be electrically connected to a conductive part (in the present embodiment, the electric conductor 12) provided on the surface of the flat cable 10. The contact point 522 is formed by processing a metal plate such that the thickness direction of a portion of the contact point 522 which is to be connected to the conductive part is parallel to the thickness direction of the flat cable 10. With this configuration, the contact pieces in the pair easily warp when the contact points are brought into contact with the conductive part. Note that the terminal 50 of the present embodiment includes only a pair of contacts 52 but may include multiple pairs of contacts 52. Each of the pair of contacts 52 includes only one contact point 522 but may include multiple pairs of contact points 522.

Moreover, in the terminal 50 of the present embodiment, the contact pieces in the pair (the pair of contacts 52) may be flexibly deformable in a direction in which the contact pieces face each other. The terminal 50 includes the base parts 541, 542 in a plate shape and the protection parts 551, 552. The base parts 541, 542 are disposed parallel to the surface of the flat cable 10. The protection parts 551, 552 protrude from edges (left and right edges in the present embodiment) of the base parts 541, 542 parallel to the connection direction of the flat cable 10 so as to be close to the flat cable 10. The contact pieces are formed by bending ends in the connection direction of the base parts 541, 542 so as to be surrounded by the base parts 541, 542 and the protection parts 551, 552. With this configuration, the base parts 541, 542 and the protection parts 551, 552 are disposed around the contact piece, and therefore, a probability that something strikes the contact piece is reduced, and thus it is possible to protect the contact piece.

The contact pieces in a pair (contacts 52 in a pair) of the terminal 50 of the present embodiment may be configured such that the distance between the contact pieces decreases as the distance from a portion where the contact pieces are connected to the base parts 541, 542 to the contact points 522 decreases. With this configuration, the flat cable 10 inserted into the gap (slit 56) between the contact pieces in the pair is led to the contact point 522, thereby achieving stable contact between the conductive parts of the flat cable 10 and the contact points 522 of the contact pieces in the pair.

The stopper member 30 of the present embodiment is locked by fitting the lugs 38*a* on the left and right side surfaces of the stopper member 30 into the stepped parts 41*a* of the housing 40 with the stopper member 30 being attached to the housing 40, but the other configurations may be used to lock the stopper member 30. For example, as illustrated in FIG. 12 to FIG. 16, the stopper member 30 may be locked by engaging a lug 39 provided on the attachment surface 31*a* of the stopper member 30 with a lug 422 provided to the housing 40 with the stopper member 30 being attached to the housing 40.

Figure 15:
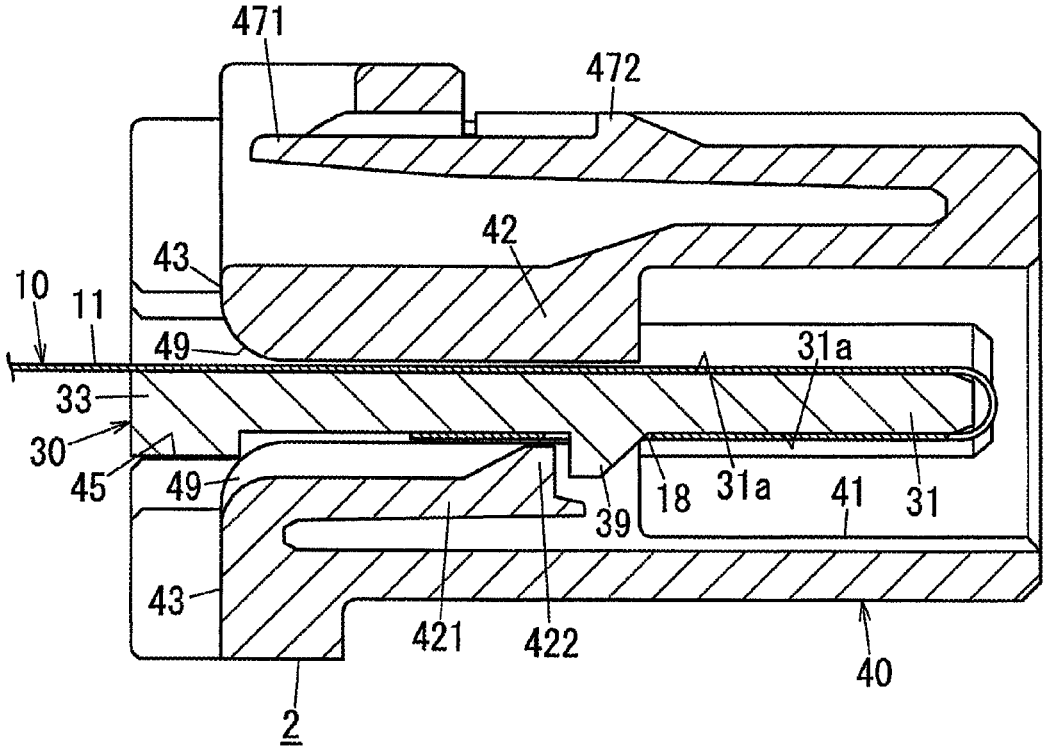
FIG. 15 is a sectional view illustrating the variation of the plug connector of the sent embodiment.

The lug 39 is provided to one of the two attachment surfaces 31*a* of the stopper member 30 (for example, a lower surface in FIG. 15).

The substrate 11 of the flat cable 10 has a square through hole 18 formed in a portion corresponding to the lug 39 of the stopper member 30. The lug 39 is exposed on the front side through the through hole 18.

In the housing 40, a flexible piece 421 is provided. The flexible piece 421 has a rear end held in a cantilever manner by the main body of the housing 40 and a front end flexible in the upward and downward direction. The flexible piece 421 faces the housing space 41 and has an upper surface provided with the lug 422 which engages with the lug 39 of the stopper member 30. The housing 40 has an upper surface provided with a flexible piece 471 having a front end held in a cantilever manner by the main body of the housing 40 and a rear end flexible in the upward and downward direction. The flexible piece 471 has an upper surface provided with a lug 472. When the plug connector 2 is connected to the receptacle connector 3, the lug 472 of the flexible piece 471 engages with an engaged section provided to the housing of the receptacle connector 3. In this way, connection of the plug connector 2 to the receptacle connector 3 is maintained.

Figure 13:
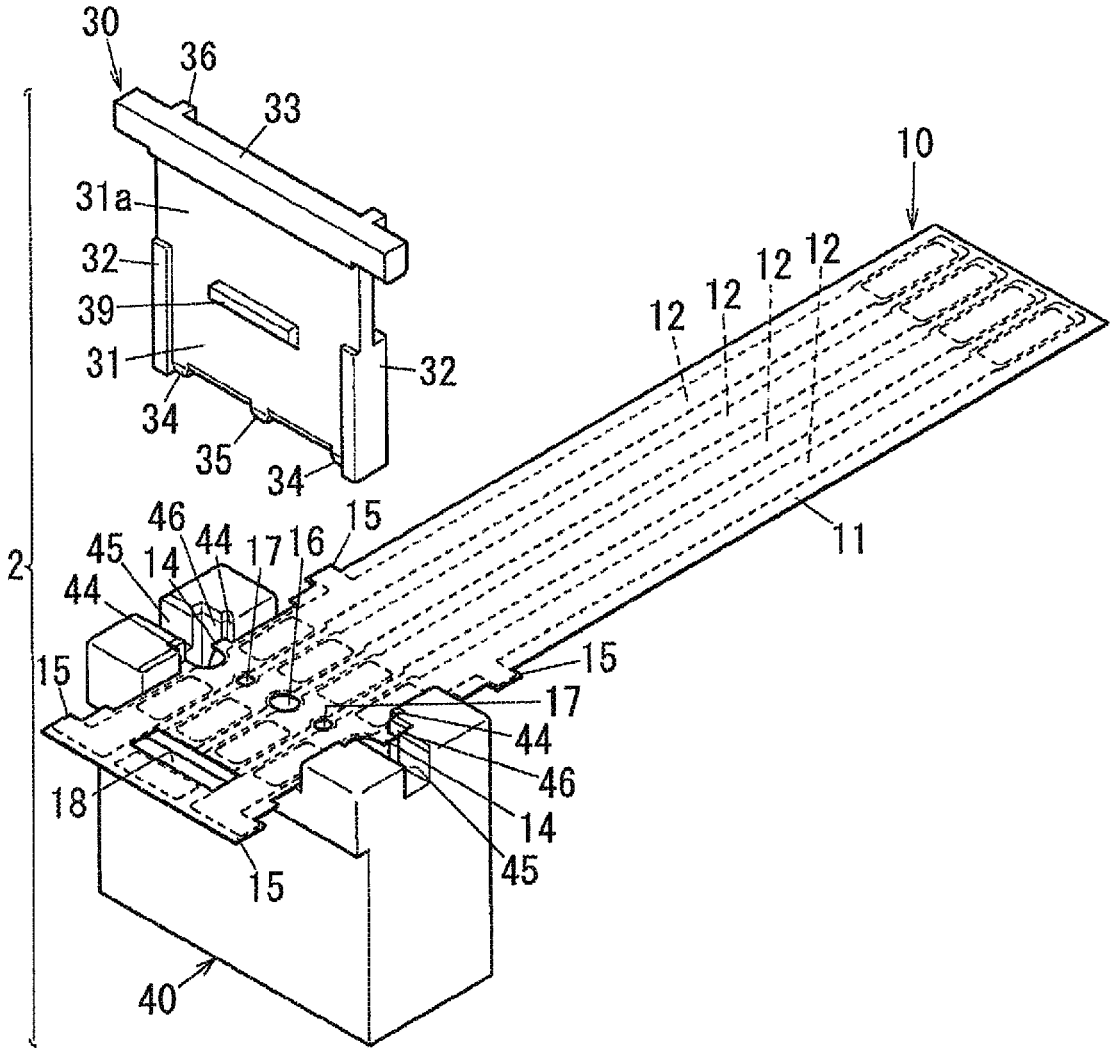
FIG. 13 is a perspective view illustrating the variation of the plug connector of the present embodiment in a step in an assembling process.
Figure 14:
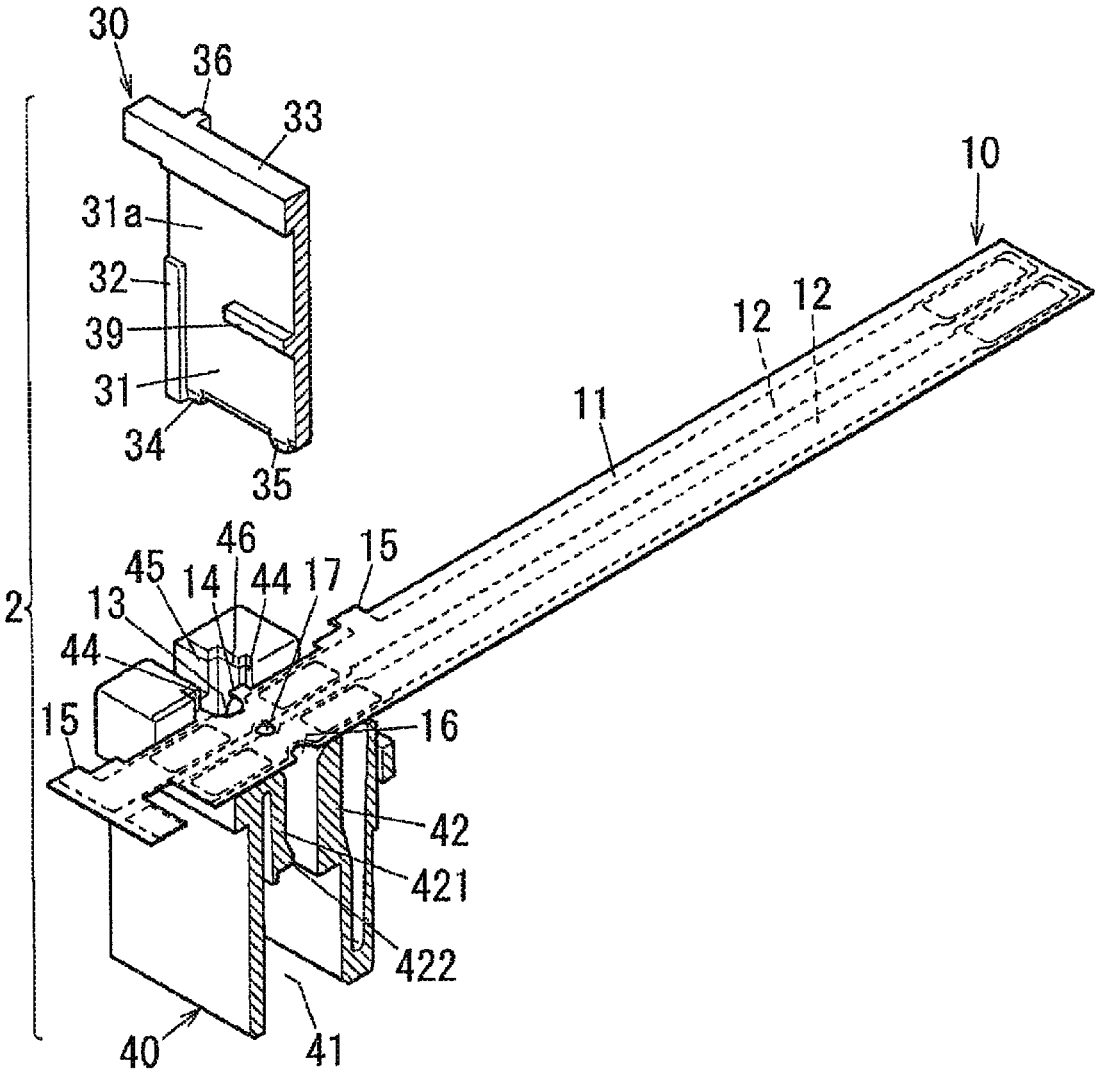
FIG. 14 is a sectional perspective view illustrating the variation of the plug connector of the present embodiment in a step in the assembling process.

A method for attaching the stopper member 30 to the housing 40 will be described below. As illustrated in FIG. 13 and FIG. 14, the flat cable 10 is placed on the mounting surfaces 43 of the housing 40, and then the flat cable 10 is pressed into the housing space 41 by the stopper member 30. While the top end of the stopper member 30 presses the flat cable 10 into the housing space 41, the stopper member 30 is inserted into the housing space 41. Then, the lug 39 of the stopper member 30 touches the lug 422, which warps the flexible piece 421 in a direction away from the stopper member 30. When the stopper member 30 is inserted to a predetermined attachment position, the lug 39 of the stopper member 30 goes beyond the lug 422, and the flexible piece 421 returns to a state before being warped, so that the lug 39 is caught by the lug 422. In this way, the stopper member 30 is locked with the stopper member 30 being attached to the housing 40.

Figure 16:
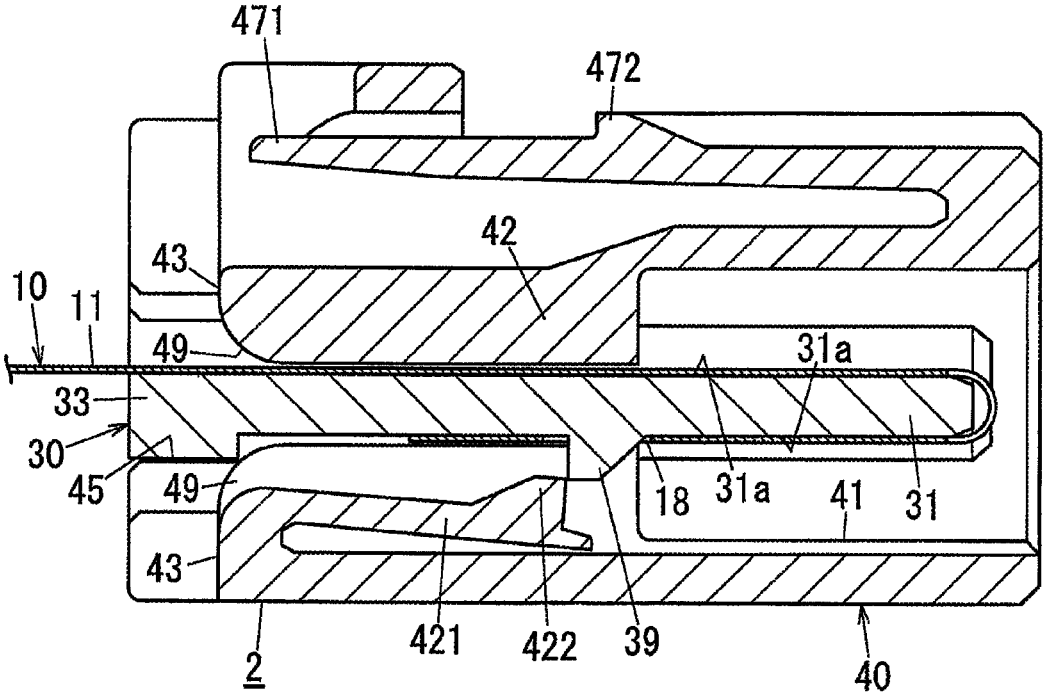
FIG. 16 is a sectional view illustrating the variation of the plug connector of the present embodiment.

When the housing 40 is detached from the stopper member 30, a tool is inserted into the opening in the front surface of the housing 40 to downwardly warp the flexible piece 421 as illustrated in FIG. 16. When the flexible piece 421 is warped to such an extent that the lug 422 moves to a position lower than the lug 39, the lug 422 is released from the lug 39, thereby unlocking the stopper member 30. In the unlocked state, the stopper member 30 is pulled rearward to detach the stopper member 30 from the housing 40.

While the present invention has been described with reference to the preferable embodiments, various changes and modifications may be made by those skilled in the art without departing from the scope of the present invention, i.e., without departing from the scope of the claims.

The invention claimed is:

1. A cable holding member, comprising:

a stopper member having an attachment surface on which a flat cable in a strip shape is to be attached in a folded state; and a housing, the housing comprising:

a housing space for housing the stopper member, a mounting surface which is provided at an opening edge of the housing space and on which the flat cable is to be placed, and a positioning section for positioning the flat cable placed on the mounting surface, wherein the housing is configured such that the stopper member and the flat cable are attachable to the housing with the flat cable being in a folded state, the folded state being achieved by pressing the flat cable placed on the mounting surface by inserting the stopper member into the housing space.

2. The cable holding member according to claim 1, wherein the positioning section is a recess into which a protrusion protruding outwardly in a width direction of the flat cable from an edge of the flat cable is to be fitted.

3. The cable holding member according to claim 1, wherein the stopper member has a stepped part protruding from the attachment surface to a side on which the flat cable is to be placed, the stepped part being configured to catch an engaged section of the flat cable.

4. The cable holding member according to claim 1, wherein the stopper member and the housing have a direction control section configured to control an attachment direction of the stopper member to insert the stopper member into the housing space in a regular attachment direction.

5. The cable holding member according to claim 1, wherein the housing has a curved surface part at a portion of the housing facing a surface of the flat cable at the opening edge of the housing space, the curved surface part having an opening width decreasing toward an interior of the housing space.

6. A plug connector, comprising:

the cable holding member according to claim 1; and the flat cable which is to be attached to the stopper member to be in a folded state and is to be partially inserted into the housing space of the housing.

7. The plug connector according to claim 6, wherein the flat cable has a flexible structure at a portion at which the flat cable is folded by the stopper member, the flexible structure rendering the portion more flexible than a remaining portion of the flat cable.

8. The plug connector according to claim 7, wherein the flexible structure is a penetrating part formed through the flat cable in a thickness direction of the flat cable.

9. The plug connector according to claim 8, wherein the stopper member has a lug to be fitted into the penetrating part.

10. A connector device, comprising:

the plug connector according to claim 6; and a receptacle connector which supports a terminal to electrically connect with an electric conductor of the flat cable and to which the plug connector is detachably connectable.

11. The connector device according to claim 10, wherein the terminal has contact pieces provided in a pair and facing each other with a gap for receiving the flat cable being provided therebetween, each of the contact pieces in the pair has a contact point to electrically contact with a conductive part on a surface of the flat cable, the contact point is formed by processing a metal plate, and the contact point has a part coming into contact with the conductive part and having a thickness direction parallel to a thickness direction of the flat cable.

12. The connector device according to claim 11, wherein the contact pieces in the pair are flexibly deformable in a direction in which the contact pieces in the pair face each other, the terminal includes base parts provided in a pair and each having a plate shape and arranged parallel to the surface of the flat cable, and protection parts provided in at least a pair and protruding from edges of the base parts in the pair parallel to a connection direction of the flat cable so as to be close to the flat cable, the contact pieces in the pair correspond to the base parts in the pair on a one-to-one basis and to the protection parts in the pair on a one-to-one basis, and each of the contact pieces in the pair is formed by bending an end in the connection direction of a corresponding one of the base parts in the pair to be surrounded by the corresponding one of the base parts in the pair and any one of the protection parts in the pair.

13. The connector device according to claim 12, wherein a distance between the contact pieces in the pair decreases as a distance from a part at which each of the contact pieces in the pair is connected to the corresponding one of the base parts in the pair to the contact point decreases.

14. The flat cable, comprising:

a substrate having a strip shape and being foldable by the stopper member of the cable holding member according to claim 1, wherein the substrate has a flexible structure at a portion at which the substrate is folded by the stopper member, the flexible structure rendering the portion more flexible than a remaining portion of the substrate.

15. The flat cable according to claim 14, wherein the flexible structure is a penetrating part formed through the substrate in a thickness direction of the substrate.

16. A method for assembling the plug connector according to claim 6, comprising:

placing the flat cable on the mounting surface to straddle an opening edge of the housing space of the housing with the flat cable being positioned by the positioning section;

inserting the stopper member into the housing space while the flat cable placed on the mounting surface is pressed into the housing space by a top end of the stopper member; and stopping the inserting the stopper member when the stopper member is inserted into the housing space to a position at which the stopper member is locked in the housing by a lock structure provided to the stopper member and the housing.

* * * * *